US010039967B2

(12) United States Patent
Dunser

(10) Patent No.: US 10,039,967 B2
(45) **Date of Patent: *Aug. 7, 2018**

(54) SOCCER TRAINING APPARATUS AND METHOD

(71) Applicant: Alex H. Dunser, Tampa, FL (US)

(72) Inventor: Alex H. Dunser, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,930

(22) Filed: Feb. 22, 2016

(65) Prior Publication Data

US 2016/0166905 A1 Jun. 16, 2016

Related U.S. Application Data

(63) Continuation of application No. 14/245,625, filed on Apr. 4, 2014, now Pat. No. 9,266,002.

(51) Int. Cl.
*A63B 69/00* (2006.01)
*A63B 63/00* (2006.01)
(Continued)

(52) U.S. Cl.
CPC ..... *A63B 69/002* (2013.01); *A63B 63/00* (2013.01); *A63B 69/345* (2013.01);
(Continued)

(58) Field of Classification Search
CPC ..... A63B 69/002; A63B 63/00; A63B 69/345; A63B 71/0619; A63B 71/0622;
(Continued)

(56) References Cited

U.S. PATENT DOCUMENTS 5,961,403 A * 10/1999 Caruso ..... A63B 69/002 473/446
6,918,845 B2 * 7/2005 Kudla ..... A63B 24/0021 473/478

(Continued)

FOREIGN PATENT DOCUMENTS

WO 2012162505 A1 11/2012
WO 2013071408 5/2013

OTHER PUBLICATIONS

International Preliminary Report on Patentability dated Oct. 13, 2016 for corresponding PCT International Application No. PCT/US 15/24501.

(Continued)

*Primary Examiner* — Mitra Aryanpour
(74) *Attorney, Agent, or Firm* — Nicholas Pfeifer; Paul Murty; Smith & Hopen, P.A.

(57) ABSTRACT

A method for improving the skills of a sports player includes arranging targets around a player-occupied central location, associating at least one visual display with each target, generating a first detectable signal and simultaneously illuminating all but one of the visual displays with a common color or pattern of lights. The visual display that is not illuminated with the common color or pattern is uniquely illuminated so that the player may identify it. A second detectable signal is generated after a predetermined lapse of time from the first detectable signal. A ball is delivered to the central location from a ball-feeding location when the second detectable signal is generated. A passing box is secured to each of the targets and a sensor is secured to each passing box. The sensor generates a signal upon detection of a ball entering into the passing box and the time of detection is recorded.

3 Claims, 9 Drawing Sheets

(51) Int. Cl.
*A63B 71/06* (2006.01)
*A63B 69/34* (2006.01)

(52) U.S. Cl.
CPC ..... *A63B 71/0619* (2013.01); *A63B 71/0622* (2013.01); *A63B 71/0669* (2013.01); *A63B 2071/0625* (2013.01); *A63B 2220/17* (2013.01); *A63B 2220/62* (2013.01); *A63B 2220/805* (2013.01); *A63B 2225/50* (2013.01); *A63B 2243/0025* (2013.01)

(58) Field of Classification Search
CPC ..... A63B 71/0669; A63B 2071/0625; A63B 2220/17; A63B 2220/62; A63B 2220/805; A63B 2225/50; A63B 2243/0025
USPC ..... 473/446, 422, 438, 470, 471, 476–478
See application file for complete search history.

(56) References Cited

U.S. PATENT DOCUMENTS 7,001,288 B2 * 2/2006 Harrell ..... A63B 69/002 473/446
7,448,968 B1 * 11/2008 Petion ..... A63B 69/002 473/446
7,896,758 B2 * 3/2011 Luby ..... A63B 69/002 473/446
8,480,517 B2 7/2013 Guttler
8,506,370 B2 * 8/2013 Homsi ..... A63B 24/0021 463/15
9,266,002 B2 * 2/2016 Dunser ..... A63B 63/00 473/446
2004/0266563 A1 * 12/2004 Young ..... A63B 69/002 473/446
2006/0068946 A1 * 3/2006 Harrell ..... A63B 71/022 473/446
2009/0069123 A1 * 3/2009 Nugent ..... A63B 69/002 473/422
2010/0285905 A1 11/2010 Guttler
2012/0108365 A1 5/2012 Guttler
2013/0012339 A1 1/2013 Rockoff
2013/0344996 A1 12/2013 Adema
2016/0166906 A1 * 6/2016 Dunser ..... A63B 63/00 473/446

OTHER PUBLICATIONS

International Search Report and Written Opinion dated Jul. 2, 2015 for corresponding PCT International Application No. PCT/US 15/24501.
Search History conducted on Jun. 3, 2015 and included with International Search Report and Written Opinion dated Jul. 2, 2015 for corresponding PCT International Application No. PCT/US 15/24501.
Extended Search Report (EPO Form 1507S) for European Application No. 15772877.5, dated Jan. 3, 2018; Applicant: Alex H. Dunser.

* cited by examiner

SOCCER TRAINING APPARATUS AND METHOD

CROSS-REFERENCE TO RELATED APPLICATIONS

This nonprovisional application is a continuation of and claims priority to nonprovisional application Ser. No. 14/245,625, entitled "SOCCER TRAINING APPARATUS AND METHOD," filed Apr. 4, 2014 by the same inventor.

BACKGROUND OF THE INVENTION

1. Field of the Invention

This invention relates, generally, to the game of soccer. More particularly, it relates to a device that helps soccer players, as well as players of other team sports that involve a single moving object, e.g., a ball or puck, improve their situational awareness and technical skills.

2. Description of the Prior Art

Situational awareness is critical for every player on a field of play, whether the game is soccer, lacrosse, hockey, or the like. Players are constantly being taught to "look up" and to "know what to do with the ball/puck/etc. before you receive it." These coaching mantras are intended to teach players to observe their surroundings (i.e. "look up") so that they can evaluate their options and decide what they will do if they receive the ball or other sports implement, such as a hockey puck before they actually receive it. As used hereinafter, the term "ball" includes any such sports implement. A player who is aware of his or her surroundings can orient their body to the ball in a manner that will allow them to efficiently receive and control the ball and then pass it on to a chosen target, all while avoiding pressure and protecting the ball from opposing players. For example, knowing where both the defensive pressure is coming from and where there is open space to move, or at least one teammate to pass the ball to, allows a player to decide what first touch to take and how to orientate his or her body to both protect the ball and be in the best position to move with or pass the ball away from defensive pressure.

The development of situational or field awareness is the most difficult part of the game for any player to learn as it is a player's natural tendency to focus on the ball. The concept of "soccer intelligence" combines a high degree of situational awareness with the ability to analyze the observed conditions and make intelligent decisions based on the observed information. It is primarily their soccer intelligence, not their technical skills, that allows players to play more quickly, i.e., make decisions and execute them more quickly, and it is this skill that separates the good from the excellent players.

It is generally accepted that the decision making process involves multiple steps or components. This phenomenon was aptly described by Colonel John Richard Boyd in the context of air combat strategy but it is not limited to such strategy. Colonel Boyd described the decision making process as a loop, which he coined the OODA loop, making reference to the mental and physical decision making and execution process performed by a fighter pilot engaged in a dog fight. The acronym OODA stands for:

Observation: Using the five senses to collect data;

Orientation: Analyzing and synthesizing the data to form a mental perspective;

Decision: Determining a course of action based upon that mental perspective; and Action: Physically executing the decisions.

In order to make a good decision, one must Observe the conditions and variables, Orient oneself in the time and space appropriate for the observed conditions (e.g., analyze and synthesize the observed data), Decide what action to take, and finally Act, i.e., execute that decision.

The speed at which a person can complete the OODA loop process is not as much limited by the physical constraints of the last step in the process, Action, but instead by the time it takes to Observe, Orient, and Decide. In the context of the game of soccer, for example, the physical action of passing a ball takes very little time; it is the process of Observing, Orienting, and then Deciding where to pass the ball to that is time consuming.

A soccer training tool sold under the trademark Footbonaut® was developed in Germany and first used by Borussia Dortmund as reported in the New York Times in an article found at goal.blogs.nytimes.com/2013/04/22/footbonaut-dortmunds-secret-weapon/?R=0.

The Footbonaut® is intended to improve a player's ability to react to balls which are fed to the player at speeds of up to seventy four miles per hour (74 mph) from one of four (4) low and four (4) high ball feeding positions. The player must control the ball fed to him/her and then pass the ball into one of sixty four (64) or seventy two (72) quadrants. There are seventy two (72) of such quadrants, eight (8) of which dispense balls, leaving at least sixty four (64) of said quadrants available as targets. The player's speed and pass accuracy are measured and recorded for evaluation purposes.

The Footbonaut® tests and challenges a player's ability to react quickly to audible and visual signals. For example, the direction from which the ball will be fed to the player is not known to the player until immediately before the ball is launched at the player. The player is alerted to the direction from which the ball will be fed by an audible signal. The player must very quickly turn to face the direction from which the ball will be fed. The player must then control the ball that is fed to him/her from either the low or high ball station. The target quadrant into which the player must pass the ball is identified by a visual cue, but not until immediately prior to or after the ball is dispensed by the Footbonaut device to the player. The OODA loop is therefore commenced only hundredths of a second before the player receives the ball. The Footbonaut device thus teaches players to improve their reaction to the ball but does not address all four (4) parameters of the OODA loop.

The Footbonaut is a complex, immobile apparatus that requires a dedicated area within a building. Its cost is reported to be between one and one-half to three million dollars. The permanent enclosed location is neither portable nor easily adaptable or configurable. Presumably for these reasons, it has been reported that the Footbonaut® is being only being used by two (2) to five (5) well-funded professional teams.

The Footbonaut® structure primarily teaches the Act/action phase of the OODA loop in that it gives a player many opportunities to practice receiving/controlling balls and then passing them into a particular target. The Footbonaut structure feeds the ball to the player from differing feed points which are not disclosed to the player until immediately before the ball is launched, thereby testing a player's ability to quickly react and turn to the direction from which the ball will be fed. Furthermore, balls are intentionally fed to the player at very high speeds or at difficult trajectories and spins, or both, to challenge the player's technical ball control skills. Finally, the player must pass or shoot the ball into a particular target quadrant which is not identified to the player until either immediately before or after the player has received the ball.

The Footbonaut device does not teach a player the most critical and time consuming steps of the OODA loop, namely the Observation, Orientation, and Decision components. The Footbonaut does not allow the player (i) to Observe the entirety of his/her surroundings to identify and differentiate between targets (teammates) and non-targets (opposing players); (ii) to Orientate himself/herself with respect to, in other words to analyze, the totality of the observed information, (e.g. direction from which the ball will be fed, the location of the designated target and the location of opposing players); and (iii) use this information to Decide on the best course of action to take in light of the observed conditions.

The Footbonaut fails at these critical tasks for a variety of reasons. First, the Footbonaut does not provide the player with any time to Observe the entirety of his/her surroundings before the ball is fed to the player. Secondly, even if the player is afforded sufficient time to observe his or her surroundings the Footbonaut does not employ multiple targets and non-targets (symbolizing opposing players) but only a single target quadrant, thereby eliminating the need for a player to observe and Orientate (analyze) his/her entire surroundings. Moreover, since the player can neither Observe nor Orientate himself/herself, the player is unable to reach the best Decision. Finally, the Footbonaut's multi-directional ball feeding structure is unrealistic to the game of soccer or any game in which only a single ball is employed. The location of the ball during a soccer match is always known to the players, in fact it is this knowledge that leads players to focus only on the location of the ball thereby falling victim to the overwhelming tendency to limit their field of vision to the area in front of them.

The Footbonaut emphasizes putting a player under duress, both physical and mental, by limiting the amount of information a player is given and forcing the player to react to the information rather than Observe, Orientate, and reach a Decision based on the information observed.

Thus there is a need for a soccer training structure that emphasizes and teaches players to habitually initiate the OOD part of the OODA loop before ball reception, rather than simply reacting under duress after having already received the ball. Such a structure should create more realistic playing situations and should teach the student/player to observe the entirety of his or her surroundings, i.e., the playing field, before the ball is received so that the player can orient or analyze this information to decide on the most optimal solution given the observed variables and finally to execute or act out that decision by positioning his or her body optimally in relationship to the direction of the oncoming ball, the location of the designated target or targets and the location of the non-targets (opposing players).

The improved training apparatus should be portable and affordable to local sports clubs, whether soccer, lacrosse, hockey clubs or the like and even individual teams.

However, in view of the art considered as a whole at the time the present invention was made, it was not obvious to those of ordinary skill in the art how the needed training structure could be provided.

SUMMARY OF THE INVENTION

The long-standing but heretofore unfulfilled need for an improved soccer and other sports training method that employs all phases of the OODA loop is now met by a new, useful, and non-obvious invention.

The novel method for improving the skills of a soccer or a player of a similar ball or puck-receiving and passing sport includes the steps of arranging a plurality of target stations in circumferentially spaced apart relation to one another about a central location. It further includes the steps of providing at least one (1) illumination means at each of said target stations. The illumination means may be a single light, a plurality of lights, or a blank space that serves as a screen upon which a light or pattern of light may be projected from a remote source. The novel method further includes the step of generating a first audible or other sense-detectable signal and simultaneously illuminating all of said illumination means in a common way, i.e., with a common detectable visual signal, with the exception of at least one of said illumination means having a detectable visual signal that is different from the common detectable visual signal. However, the illumination of the targets need not be accompanied by a first audible or other sense-detectable signal, i.e., it is within the scope of this invention to let the illumination of the targets serve as the first signal and to measure all subsequent time periods with reference to the time of said illumination.

Accordingly, where each target station is provided with one light per station, when all of the targets are illuminated, all but one of the lights could have a common color such as red and one of said target stations could have a green light. The player would then know to pass the ball to the passing box of the target station with the green light. Where a player is to be given two passing options, one preferred over the other, all but two of the lights could have a common color such as red, and of the two target stations lacking the common color, one of them could have a green light, and one of them could have a blue light (or blinking green light, for example). The player would understand that the green light target station would still be the preferred target but the blue light (or blinking green light) would represent an acceptable alternative target. This trains a player to see all possible targets and helps the player develop a 360 degree awareness, which allows the player to see every option and determine the best possible target.

Instead of each target station having a single light or screen upon which a single color is projected, each target station may be provided with a plurality of lights or a screen upon which a plurality of light patterns may be projected. This arrangement could be used in much the same way as the single light embodiment, but it could also be used differently. For example, instead of having one green light pattern among a common pattern of red lights, all but at least one of the illumination means could produce a plurality of vertical columns of red light and one of the illumination means could produce a plurality of horizontal rows of red light. Numerous variations of the at least one different illumination means are possible, including vertical columns of green lights, horizontal rows of green lights, diagonal strips of red lights, diagonal strips of green lights, i.e., any different pattern or color to distinguish at least one target from the others. Introduction of a third color or even a third pattern would indicate an alternative, secondary target. As an example, all of the non-targets could display columns of red lights, the primary target could display horizontal rows of red lights, and the secondary target could display diagonal strips of red lights. As another example, all of the non-targets could display vertical columns of red lights, the primary target could display vertical columns of green lights, and the secondary target could display diagonal strips of green lights or vertical columns of blue lights. There are a large number of combinations of patterns and lights and all of such combinations are within the scope of this invention.

The target stations may be arranged in equidistantly spaced relation to the central location or the spacing may be unequal. Moreover, the circumferential spacing between the target stations may be consistent or varying. Such irregular distances from the center location to the individual target stations better mimics a real life playing situation where players are not uniformly surrounding the player who receives the ball, i.e., some are radially closer and some are radially further away and they are spaced apart from one another at irregular circumferential spacings as well.

In the embodiment where only one target station is preselected by a coach, the one preselected target station that is not illuminated with said common, predetermined light color or pattern of lights is illuminated with a light color or pattern of lights unique to it. A player at the central location is instructed to observe all of the target stations and determine which one of them is illuminated in a light color or light pattern that differs from the light color or light pattern of all of the other target stations. The player is positioned at the central location and therefore is required to look in all directions, i.e., three hundred sixty degrees (360°), full field of view, in order to determine which target station or stations is illuminated with a unique light color or lighting pattern.

In an embodiment, a second detectable signal may be generated after a predetermined or random lapse of time from the generation of the first audible/detectable signal. A detectable signal includes vibration of a device worn by a player, various visual signals, and the like, i.e., the term "detectable signal" includes audible, visual, and tactile signals detectable by a human ear, eye, or sense of touch, respectively. A soccer ball is delivered to the central location from a predetermined ball-feeding location when the second detectable signal is generated. In an embodiment, the second signal may simply be a player calling for the ball rather than an automatically generated signal. The predetermined ball-feeding location is selected by the coach and therefore it may be further from or closer to the central location than one or more of the target stations. Most coaches will probably deliver the ball to the player when stationed near the player to ensure more consistent and better placed deliveries. However, it is within the scope of this invention to eliminate the second audible/detectable signal. All time measurements in the absence of a second signal would be made from the first signal or the time of target illumination in the absence of a separate first signal, i.e., if there is no second signal, the time measured would end when a ball is detected entering a passing box or when a preselected default time has elapsed.

None of the parts of the invention have fixed positions. The location where the player is directed to stand is arbitrarily selected, as is the number and spacing of the target stations. The location of the ball-dispensing device, whether a machine or a coach, is also arbitrarily selected. The only requirement is that the player must know where the ball will be dispensed from because in competition the player will know where the ball is and no worthwhile skill is taught by surprising a player with the direction from which the ball will be fed to him or her.

In an embodiment, the base of each target station includes a passing box into which a player must pass the ball after it is delivered to the player. A sensor is mounted to the entrance of the passing box and generates a detection signal upon detection of a ball entering the passing box. If the sensor does not detect a ball entering the identified passing box within a set timeframe, a miss is recorded. Each sensor-generated signal is transmitted and recorded. The sensor could take many forms such as a light curtain employing infrared or laser detection fields, a pressure pad, an ultrasonic sensor, a photoelectric sensor, and the like. The signals from each passing box sensor is preferably transmitted wirelessly to a central location such as a computer, smartphone, or tablet equipped with a suitable receiver. In an embodiment, there exists a designated master station among the plurality of stations. The master station communicates with each slave station and relays information between the slave stations and the mobile computer device.

The predetermined lapse of time from generation of the first detectable signal to generation of the second detectable signal is increased for players of relatively low skill levels and decreased for players having high skill levels relative to said players of relatively low skill level. By doing so a player is either given more or less time to complete the OOD portion of the OODA loop before the ball is fed to him or her. As a player uses the present invention and improves his or her field of vision, situational/field awareness and decision making ability, this time interval can be decreased to continue to challenge the player. This time interval can be manually set by a coach or set as part of a software program designed for players of different ages, different skill levels, or both. The software may include programs that test the base level skill of a player, i.e., testing how well or how quickly the player identifies the correct target but also to see what physical motions the player has problems with, such as receiving a ball on the left side and turning to the right to pass with one or the other foot, depending upon which foot of the player is dominant.

The elapsed time from the time of the second audible/otherwise detectable signal to the time that a ball, puck, or the like is detected by a sensor secured to the entrance of the passing box is also measured and recorded. However, as already mentioned, it is also within the scope of this invention to eliminate the second detectable signal.

Since there may be a delay between the generation of the second detectable signal, if provided, and the delivery of the ball by a coach, a time period may also be measured from the actual ball delivery to the time a sensor detects a ball entering the passing box. This time period can be measured by various methods. In the preferred embodiment the coach is equipped with a conventional accelerometer sensor, not depicted, which can detect the motion of the coach kicking or throwing the ball to the player thereby triggering and commencing a time measurement that ends when the ball is detected by the sensor secured to the passing box or when a default time has elapsed. In another embodiment, a conventional sensor is located at the ball-feeding location through which the coach passes the ball to the central location thereby triggering and commencing a time measurement that ends when the ball is detected by the sensor secured to the passing box or when a default time has expired.

However, in a simpler embodiment, the time period measured is the time between the second detectable signal and the time that a ball, puck, or the like is detected by a sensor secured to the passing box. Each miss is also recorded so that the player's accuracy can be measured. A "miss" is the default when no ball is detected passing into the designated passing box within a pre-determined time period following the second detectable signal as aforesaid. Similar to the time interval between the first and second audible/detectable signals, this time interval can be manually set by a coach or set as part of a software program designed for players of different ages, different skill levels, or both. This time interval may be increased for players of relatively low skill levels and decreased for players having high skill levels relative to said players of relatively low skill level. The shorter this time interval is the less time the player has from his receipt of the ball from the ball feeder to execute (e.g. Act out) the decision made between the first and second detectable signal. If a player does not successfully pass the ball into the designated passing box before this time interval expires, or if the ball fails to enter the designated passing box, the ball will be counted as a miss.

In more advanced versions of the method, more than one target station may be illuminated with a light color or light pattern that differs from the light color or light pattern displayed by the remaining ("non-target") target stations, and in a still more advanced method, the number of different light colors or light patterns displayed on one or more of the target stations will be different from one or more of the remaining target stations, thereby providing the player with additional information to observe and analyze before making a decision. For example, it would be possible for each target station to display a light color or light pattern that is different from each of the other targets stations so that every target station is unique and the player must pass the ball to one light color or light pattern which is predetermined by the coach or the software program. Additionally, it is conceivable that target stations would be designated by a hierarchy based on light colors or light patterns where one target station may be ascribed a higher or lesser value compared to other target stations displaying a different light color or light pattern.

The light or lights on each target station may stay on for the duration of each drill, being turned off at the end of each ball sequence and then reset when the next ball is dispensed. In a first alternative, the lights could remain illuminated only until the second detectable signal is generated so that a player who did not observe and identify the designated target station in the predetermined time (the interval between the first and second detectable signals) will not know where to pass the ball thereby forcing them to observe their surroundings and locate the designated target station faster on their next attempt. In a second alternative, one or more lights may change to another light color or light pattern forcing the player to confirm that the designated target has not changed between the time the player first observed it and before the player passes the ball. For more advanced players having the designated target change after the second detectable signal would add a substantial but very realistic challenge (mimicking a teammate who was open for a pass when the player first saw him but who is covered/marked by an opposing player once the player has received the ball and is ready to pass it on) which would force a player to restart the OODA loop process. These variations can be altered based on a player's skill level to increase or decrease the difficulty of the drill similar to how the time interval between the first and second detectable signals is increased or decreased. There are countless variations that can be derived by alternating the variables of time intervals, light color or light pattern, as well as the location and even the environment of the light stations.

The novel structure improves and accelerates the OODA loop process by teaching players to begin the loop early, i.e., before they receive a pass so that they only need to execute or act out the decision once they receive the ball, puck, or the like, having already observed the unique target and oriented themselves in the most efficient position to receive/control the ball and to pass or move the ball to that unique target.

The goal of teaching situational awareness and soccer intelligence is not new and coaches have developed many differing training drills to attempt to teach these skills. However, it is very difficult to create training situations where individual players are forced to develop these skills and even more difficult to provide each player with the number of repetitions necessary to ingrain these skills in the player. For example, as to the development of situational awareness, it is very difficult to force players to observe beyond their immediate field of vision, i.e., to look beyond what is immediately in front of them. Humans have a one hundred forty degree (140°) binocular field of vision. Soccer players, and players in similar sports, have a natural tendency to watch the ball, puck, or the like and it is very difficult to break players of this tendency and have them expand their field of vision (by moving their head and body) and develop an awareness of the conditions surrounding them. As a result players typically receive the ball, puck, or the like without having observed the conditions outside of their natural but limited field of view, and are immediately placed under stress by opposing players, which in turn forces players to rush and make poor or less than ideal decisions.

Accordingly, when coaches try to teach players to "keep their head up" and "look around," players naturally look in front of themselves or in the direction of the ball, or both. It is very difficult to teach players to look and see what is outside of their one hundred forty degrees (140°) field of vision. Stress may even reduce this field of vision. The remaining two hundred twenty degrees (220°) is often ignored by players. Thus, passing options are often present but are not observed by players because the have not expanded their field of vision to observe the entirety of their surroundings (a three hundred sixty degree (360°) observation). Moreover, typically if a player has not observed the entirety of their surroundings before receiving the ball they will no longer have time to do so due to pressure applied by opposing players.

Coaches routinely attempt to create training scenarios that force players to develop their situational awareness and use this awareness to make quicker and better decisions with the ball. The most common of these training scenarios is the small-sided possession game. The game is very simple; a group of players is divided into two (2) smaller teams of between four (4) and six (6) players each. One team starts with the ball and has a singular objective to maintain possession (keep the ball away from the other team) by passing the ball among them while staying within the confines of a small area designated by a plurality of cones. The team without the ball also has a singular objective, namely to disrupt the other team's possession by intercepting or otherwise causing the team with the ball to lose possession of the ball or cause the ball to go outside the designated playing area, i.e. out of bounds. The playing area is intentionally small so as to make the area seem crowded with players; the smaller the area the harder it is to maintain possession. The players on the team with the ball quickly realize that in order to maintain possession of the ball they must pass it very quickly after receiving it as they will immediately be under pressure by one or more players from the other team. The drill continues with each team trading between the role of being the team that tries to maintain possession and the team that tries to disrupt possession. Coaches will often limit the players with the ball to one (1) or two (2) touches, meaning each player can only touch the ball that many times before another player on their team receives the ball from them. If the limit is two (2) touches, a player can take one touch to control the ball but the second touch must be to pass the ball to another a teammate. This added restriction emphasizes to the players how important it is to observe their surroundings so that they can make a decision as to what to do with the ball before they receive it so as not to run out of touches.

The objective of this possession drill is precisely what the present invention is designed to improve, which is for players to observe the entirety of their surroundings, evaluate their observations and try and figure out (decide) what to do with the ball before they receive it otherwise they will run out of time (due to the pressure put on them by opposing players) or touches and will not be able to maintain possession of the ball.

While the theory of small-sided possession drills is sound, it fails to address players' natural tendency to limit their look and play only within their field of vision, i.e., forward. Even experienced players tend to look and find passes that are in front of them, i.e., within their natural field of vision. Players will often situate themselves along the boundary of the playing field/area thereby allowing themselves to ignore everything behind them (180 degrees of their surroundings) since it is outside the field of play. Furthermore, the actions of a player's teammates can inhibit a player's development of situational awareness, in that teammates naturally recognize that it is much easier for the player with the ball to see them and to find them if they are in that player's field of vision.

From a training perspective it is very difficult for a coach to objectively determine whether players are really expanding their field of vision by turning their heads and looking around them 360 degrees with these drills. The present invention forces players to observe the entirety of their surroundings before they receive the ball and will, through repetition, cause players to habitually use an expanded field of vision in both practice and game situations. Moreover, the present invention will allow coaches to objectively test a player's situational awareness and track their improvement by providing objective measurements, including the speed in which the player can complete the OOD portion of the OODA loop, as well as the speed and accuracy with which the player can execute a decision.

An important object of this invention is to provide a method for training soccer players as well as players in other ball or puck-handling sports to observe the entirety of their surroundings quickly to determine which players near them are opposing players or otherwise ineligible to receive a pass and which players are available to receive a pass. The present invention can easily designate target stations as "non-targets" (targets to which a player cannot or should not pass the ball, or targets that represent opposing players from whom the ball should be shielded/protected) simply by illuminating those target stations with light colors or light patterns different from the target stations to which the player can or should pass the ball.

Another object is to train players, after determining which of the target stations is the target station or stations to which the ball can be passed, to physically position themselves in an optimal position to receive and control the ball dispensed from a ball-feeding location in relation to the designated target stations as well as the non-targets representing opposing players from whom the ball must be shielded. The concept of shielding the ball from one or more opposing players is critical to the game of soccer as well as to other sports in which possession of a ball, puck or the like is integral to the sport. The present invention can easily be used by two or more players at the same time with one or more players being designated as offensive players and the remaining players or players being designated as defensive players. The offensive player or players would continue to have to go through the OOD portion of the OODA loop decision making process in order to identify the designated target station or stations to which the ball can or should be passed, but would now also need to observe and analyze the number and position of "live" and dynamic teammates and defenders when deciding how to receive the ball from the coach or dispensing device and then how to effectively pass the ball to the designated target station. Again, there are countless variations of drills that can be created by a coach or by a software program by varying not only the aforementioned variables, but with the addition of multiple live players assuming different roles.

Another object is to train and improve players' "first touch" on the ball. "First touch" refers to the first physical contact that the player makes with the ball. In the present invention the first touch may be controlling a ball fed from the ball-feeding location. The first touch is considered to be the most critical technical skill in the game of soccer as it dictates what the player can do with his or her second touch. For example if a player's first touch results in the ball being on the player's left side and the player is right foot dominant and cannot make an accurate pass with his left foot, then it was not (absent other overriding considerations) a good first touch. In the present invention, a good first touch would be a touch that allows a player to quickly and efficiently pass the ball into the designated target station while protecting the ball from non-targets representing opposing players or live opposing players participating in the drill. By varying the location of designated target stations in relation to the direction from which the ball is fed to the player and by providing many repetitions, the invention will train players to improve their first touch as well as their other basic techniques, such as by example only the ability to turn in both directions (left and right) with the ball.

Another object is to train players to execute a decision by performing the action of kicking (passing) the ball with accuracy to the designated target station. The size of the passing box can be altered to increase or decrease the difficulty of the exercise. A portion of the passing box could be covered to effectively reduce its size from full size by inserting simple boards to reduce the height or width, or both, of the passing box. Also, the distance from the player to the target stations can be increased or decreased to vary the difficulty associated with successfully passing the ball into the designated passing box.

Further objects include the provision of a training apparatus that is portable, affordable, self-powered using batteries, and having wireless communication capabilities.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
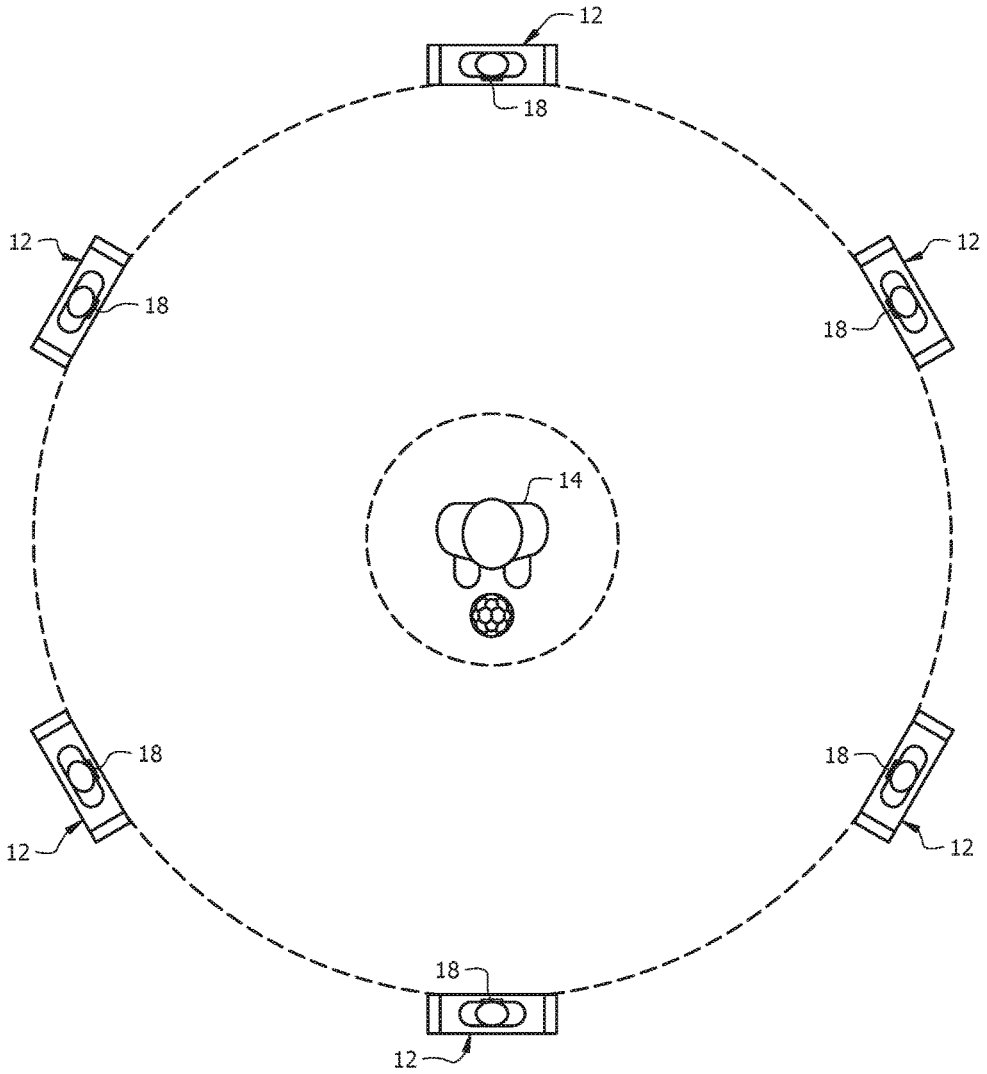
FIG. 1 is a top plan view of the novel structure, depicting a plurality of target stations surrounding a central location.

FIG. 1 depicts an illustrative embodiment of the novel structure which is denoted as a whole by the reference numeral 10.

In this embodiment, six (6) target stations, collectively denoted 12, are arranged in circumferentially and equidistantly spaced relation to one another about a central player's location 14. The number of target stations 12 may be increased or decreased. In a preferred embodiment, each target station 12 is positioned about seven (7) meters from center 14 but that distance may be changed to any desired distance as to all or any number of target stations. Moreover, there is no requirement that all of the target stations be the same distance from center 14 nor is there a requirement that target stations 12 be equidistantly spaced from one another. Irregular target station placements and irregular distances are preferred because such irregular patterns more realistically simulate actual game situations.

Figure 2:
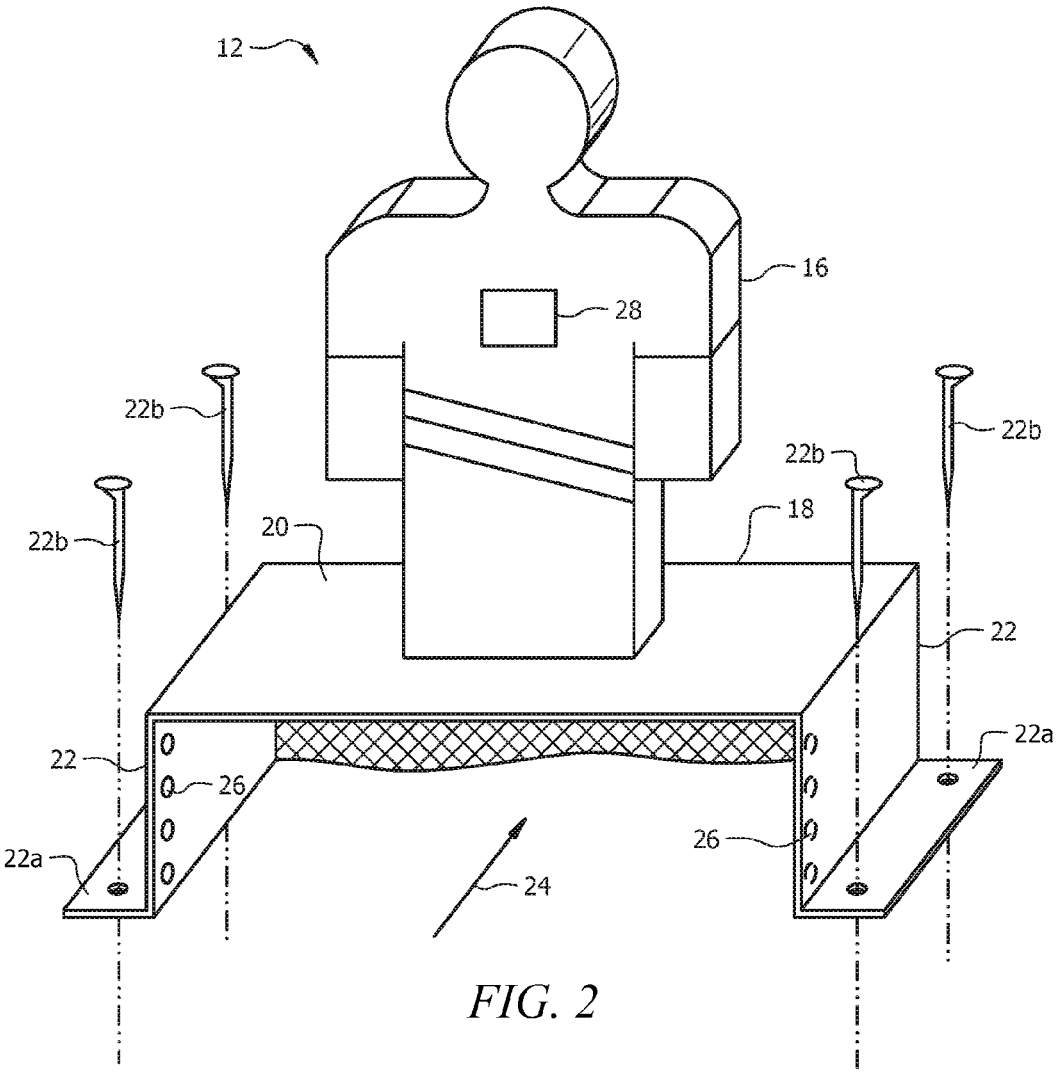
FIG. 2 is a perspective view of a target station, depicting its light box, its pass-receiving basket, and the ball-detecting sensors.

As best depicted in FIG. 2, each target station 12 is preferably formed of a light-in-weight, high impact plastic and includes a silhouette part 16 that is shaped to simulate the head, shoulders and torso of a soccer or other sports player. The opposing extremes of providing a more realistic target in the form of a more realistic player or providing a more abstract target looking less like a player are within the scope of this invention. The target stations are preferably nestable relative to one another so that they can be stacked for easy transport. Silhouette part 16 is preferably a separate flat piece that is supported by base 18. Flat silhouettes 16 are stacked on top of one another and bases 18 are nested with one another. Each base 18 forms a protective housing for the stacked silhouettes when inverted to form a basket and the entire package is portable in a "body bag" with wheels.

In the alternative, it may be preferable to have silhouettes 16 made of a fabric or fabric-like material with a semi-rigid form to simulate the head, shoulders and torso of a soccer player, which fabric silhouette could be slipped over a pole or structure supporting the target station illumination means.

A preferred form of base 18 includes top horizontal wall 20 that is approximately one (1) meter wide and which is supported at its opposite ends by a pair of laterally spaced apart legs, collectively denoted 22. The distance between wall 20 and the ground is preselected so that it is sufficient to receive a well-passed ball. The space bordered by horizontal wall 20, legs, 22, 22, and the ground is hereinafter referred to as the ball-receiving area or the passing box and is denoted 24.

Legs 22 are preferably provided in telescoping or other form that enables their respective heights to be easily increased or decreased. The height of horizontal wall 20 is spaced close to the ground to require a more accurate and controlled pass thereby challenging accomplished players and is spaced further from the ground to allow less accurate and less controlled passes to accommodate the skills of less accomplished players. The height may be adjusted upwardly for other reasons as well such as to compensate for a poor playing surface, to allow more room to receive bounce passes, and the like and of course the height is never less than the diameter of the ball that is received within the ball-receiving area.

For the same reasons, horizontal wall 20 may also be provided in expandable form to increase or decrease its width as a coach may determine for each payer.

Flanges 22*a*, 22*a* may be provided at the respective lower ends of legs 22, 22. Each flange may be apertured as depicted to receive spikes 22*b* that secure base 18 to the ground. Weights may be applied to overlie flanges 22*a* to supplant or supplement said spikes.

Each base 18 also has a light curtain sensor 26, 26 that registers a ball entering into passing box 24. Sensors 26, 26 may take the form of a photoelectric sensor that is adapted to generate and transmit a detection signal upon detecting the breaking of the light beam by a ball entering into passing box 24. The sensor also generates and transmits a default signal if a predetermined period of time passes after the sounding of the second detectable signal and the beam is not interrupted during that time. All signals are received and recorded by a suitable computer device.

A coach can compare the passing box totals at the end of a training session with the number of balls that were delivered to the player to determine a player's strengths and weaknesses. Future training sessions can then be designed to work more on the weaknesses and less on the areas that need little work.

The recorded information can be whatever information a coach may desire to record, such as the end tally of hits vs misses and times elapsed between the second detectable signal or the time of actual ball delivery and the hit or miss. The software can include a drill sequence of twenty (20) balls, for example, with predetermined patterns of designated targets that challenge each of the player's skill sets. Moreover, the coach who dispenses the ball has a large degree of control over the speed, height, direction and spin of the ball so that the ball can be passed to the player's right, left or center at any height and at any coach-selected speed or spin, thereby either increasing or decreasing the difficulty of the drill. The drills may include directions to the coach, generated by software, as to where and how to feed the ball to the player; e.g., the software may instruct the coach to feed the ball to the player's right side with the designated target station being located behind and to the left of the player, thereby forcing to take a different first touch on the ball, perform a different turn with the ball and pass the ball with a specific foot, and so on.

An LED light box 28 is preferably positioned in the center of each target station 12. In a preferred embodiment, the LED light displays multiple differing colors. Four (4) is the preferred minimum number of colors. LED lights are merely the preferred type of lights. Any visual display capable of producing different patterns of light or different colors is within the scope of this invention.

The invention includes an embodiment where LED light box 28 is replaced by a blank, screen-like surface upon which light is projected from a predetermined central location or plural locations or from base 18 of target station 12 itself. The use of projected light is desirable because such use removes the requirement for each target station to have its own LED light box 28 or other form of visual display and enables silhouette part 16 to be provided inexpensively, such as a durable fabric that is stretched over a flexible and durable frame.

Although a visually-detectable display of light colors or patterns is the preferred way of notifying a player of the targets and non-targets that surround the central player's location, all other human-detectable notifications are within the scope of this invention. Humans are poor at locating the source of a sound, and even poorer at locating the source of a particular sound when several sources are generating sounds, but causing five (5) target stations to play a common musical tune and one (1) of said stations to emit a high volume blast of horn or siren-like sound is within the scope of this invention.

Moreover, physical movements of the target stations for player-notification purposes is also within the scope of this invention. For example, a structure where five (5) target stations would reciprocate up and down and one (1) target station would spin around or reciprocate to the left and right would also be within the scope of this invention. The passing box of such a target station would not be subject to such movement.

Figure 3A:
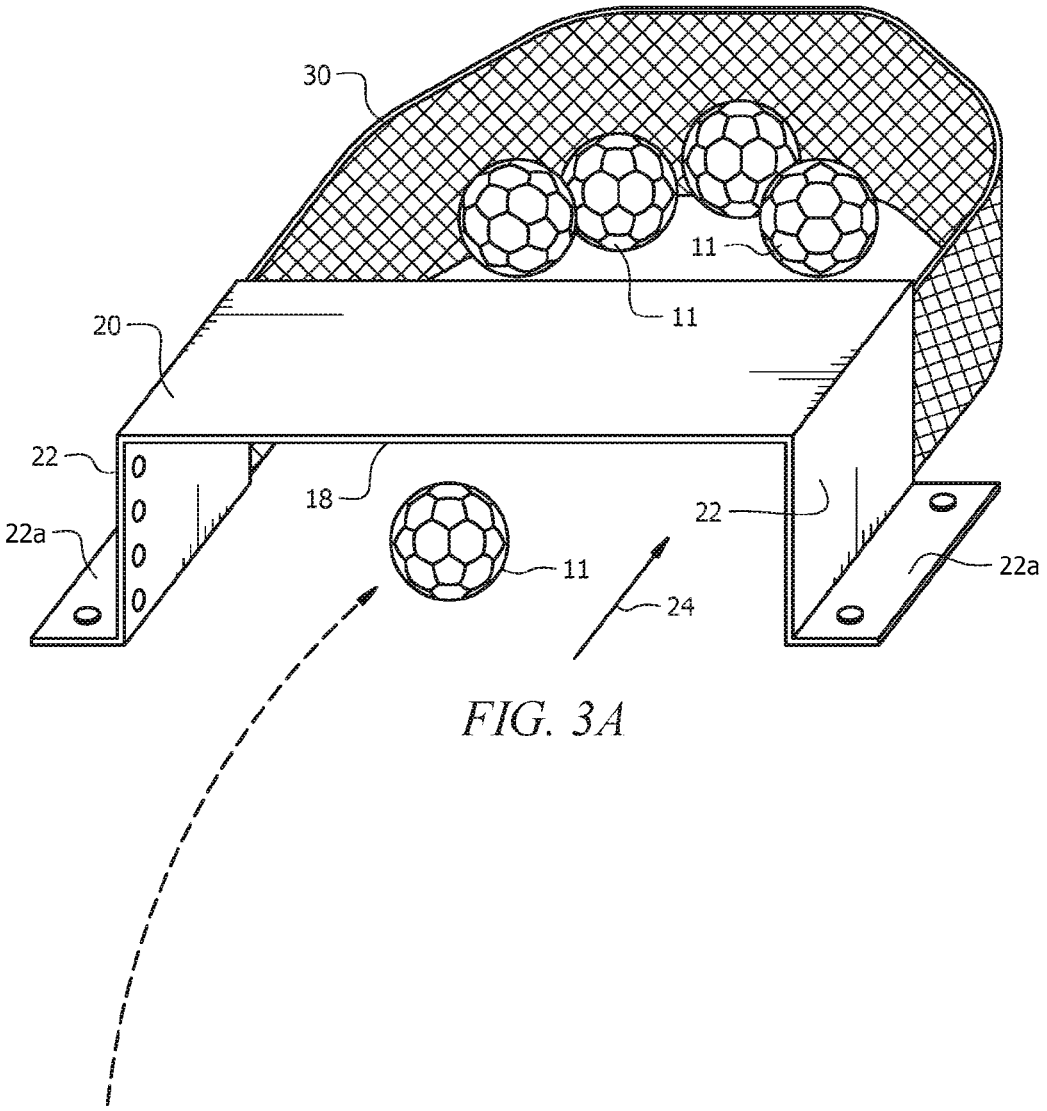
FIG. 3A is a perspective view of a target station base and a ball corral connected to said base.

As depicted in FIG. 3A, balls collectively denoted 11 that have been passed into passing box 24 are collected behind each base 18 in a ball corral for easy retrieval. Net 30 has its opposite ends secured to base 18 as depicted. Net 30 may be expandable so that it lengthens as more balls are passed into it. Net 30 is positioned on a radially outward side of said base so that it does not interfere with a ball entering passing box 24 but collects each ball that enters said passing box on said radially outward side of said base.

Figure 3B:
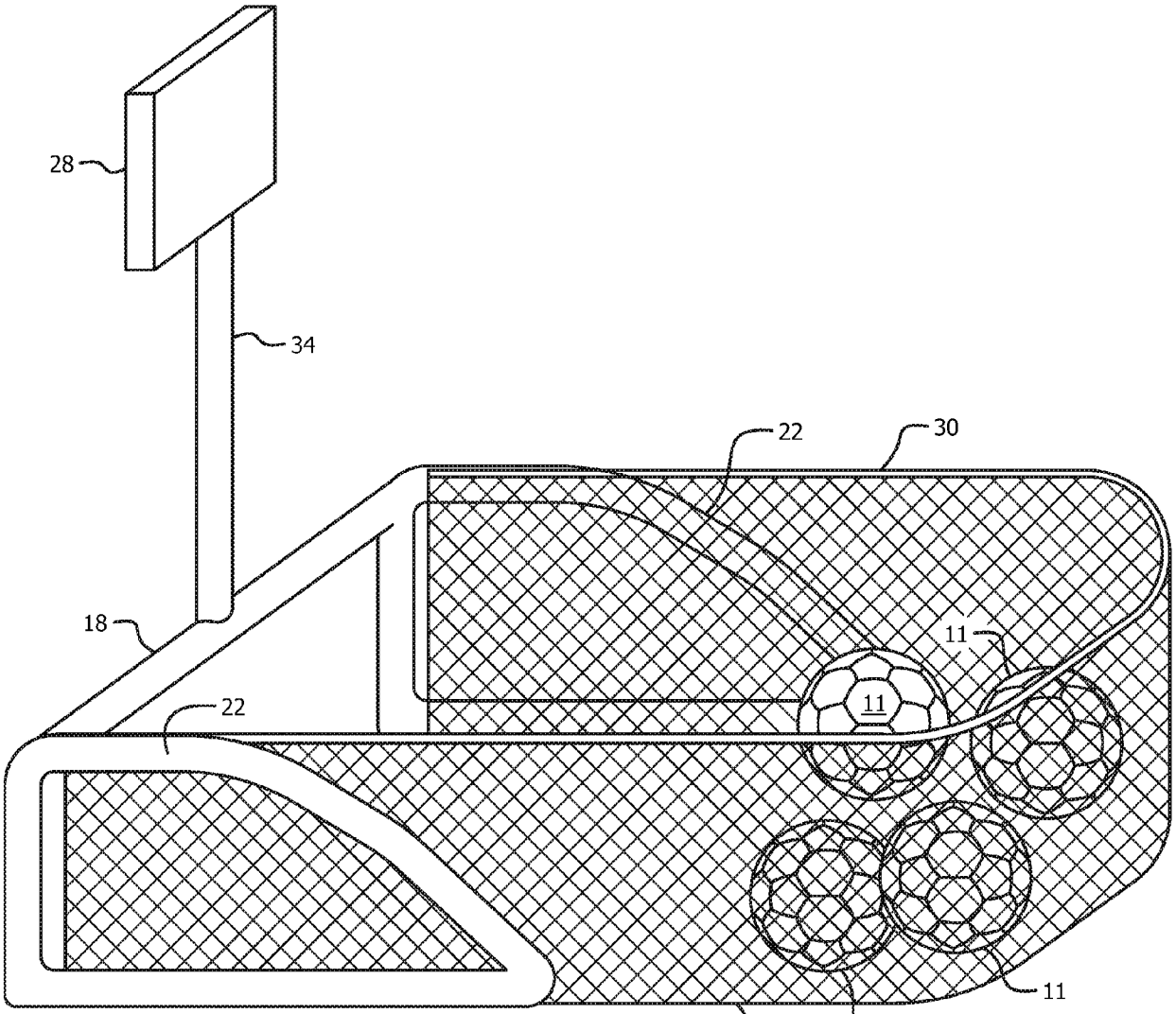
FIG. 3B is a perspective view of a ball corral connected to the embodiment of FIG. 6C.
Figure 6A:
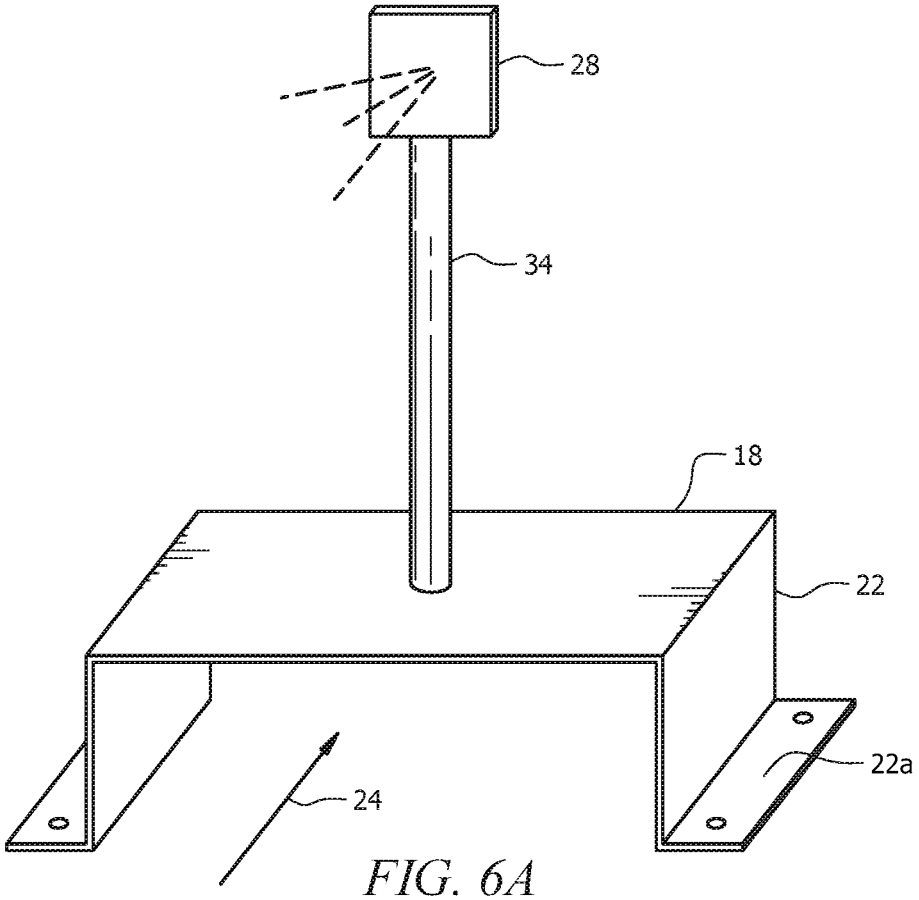
FIG. 6A is a front perspective view of a simplified target station.
Figure 6B:
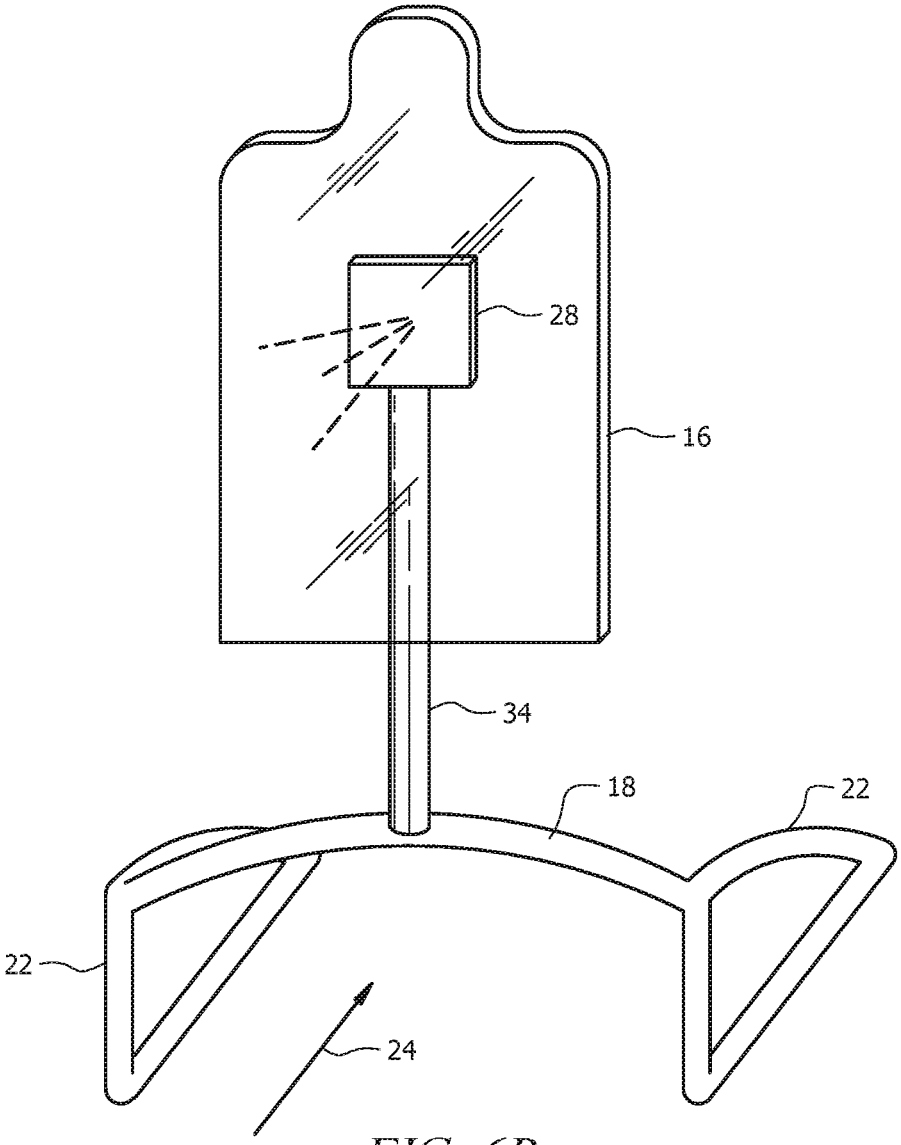
FIG. 6B is a front perspective view of a variation of the embodiment of FIG. 6A.
Figure 6C:
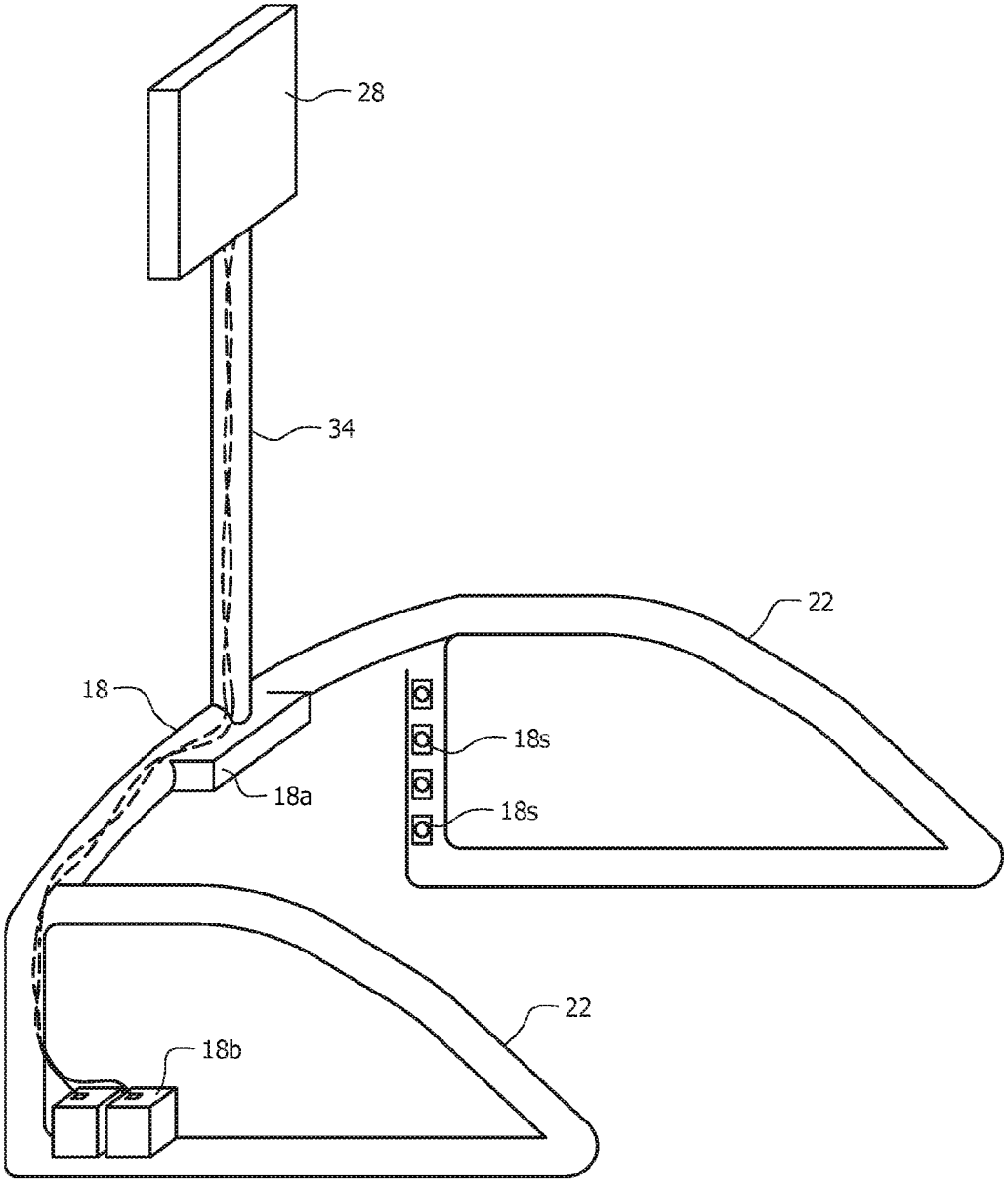
FIG. 6C is a rear perspective view of the structure depicted in FIG. 6B.

FIG. 3B is a rear perspective view of a ball corral connected to the embodiment of FIG. 6C. This is provided just to illustrate that a ball-corralling net can be attached to any base 18.

Figure 4:
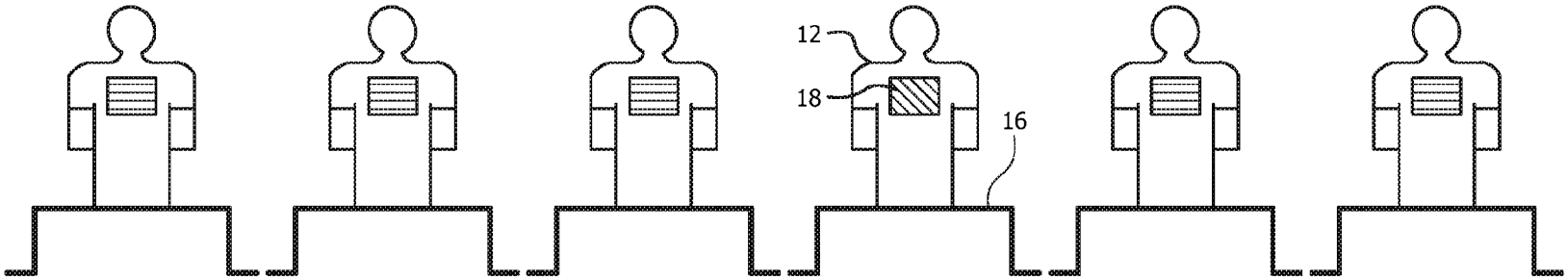
FIG. 4 depicts a plurality of target stations where one target station is illuminated in a way that differs from the illumination of the other target stations.

FIG. 4 depicts six (6) target stations in a linear array, it being understood that a player at central location 14 would see these target stations in surrounding relation to said central location and not aligned as depicted. One (1) of the target stations 18 is illuminated in a different pattern than the other target stations, thereby identifying it as the target. In this particular example, one visual display 28 produces a diagonal pattern of lights which easily distinguishes it from the horizontal pattern produced by all of the other visual display. The player therefore upon detecting the first signal will look in all directions to locate the position of the target station 12 that has a unique lighting pattern and will begin and complete the OODA loop so that his or her body is well-positioned to pass the ball into the identified passing box 24 when the ball is delivered. Again, the first signal may be the illumination of the visual displays and not necessarily a separate visual, audio, or tactile signal that is generated when the visual displays are illuminated.

In a further embodiment, more than one target station could be illuminated with an odd color or colors or light pattern or light patterns. For example, a majority of target stations may display solid blue lights and two (2) target stations might each display a red light and one blinking blue light. In that scenario, the player may direct the ball to either one of the two (2) target stations that differ from the majority of target stations.

In yet another embodiment, a majority of target stations may display blue lights, one target station might display a red light, and the remaining target station may display a green light. The player would understand that both of the oddly illuminated target stations (the red and green stations) were the target stations preselected by the coach or software, and that the green target station is the primary target and the one with one red light is the secondary target. A blinking light could also be defined as indicating a primary or secondary target, i.e., the use of differing light colors is not the only way to distinguish the lights from one another.

The primary target would likely be designated to be outside the player's natural field of view and the secondary target within the natural field of view, thereby testing whether the player is observing the entirety of his or her surroundings or whether he or she stops observing as soon as he or she sees a target even though only a secondary target. The idea that there can be multiple possible targets further supports invention's ability to force the player to look in three hundred sixty degrees (360°) so as to not miss the primary target. Target stations 12 with a common lighting represent opposing players or players on the same team who are well-defended and thus to whom a pass should not be sent.

Accordingly, at the generation of the first detectable signal and the illumination of the target stations, the player begins the OODA loop by observing all of the targets in order to determine which target is the designated target for that ball sequence.

It is within the scope of this invention to eliminate the first detectable signal as aforesaid and to allow the illumination of the targets to be the only signal perceived by a player. It is also within the scope of this invention to eliminate the second detectable signal as aforesaid and to allow the delivery of the ball to the player to take place at the coach's discretion. The only measured time intervals when no first signal is generated simultaneously with activation of the lights and no second signal is generated to announce ball delivery is the interval of time between the activation of the lights and the detection of a ball entering into a passing box or the interval of time between said light activation and the expiration of a default time interval. Again, the use of sound, movement, or other human-detectable signal may replace such light activation.

A coach or software may also illuminate two targets with a minority pattern as aforesaid, giving the player two (2) targets and four (4) non-targets in a six (6) target configuration.

When a player has discerned the status of lights on all of the target stations, he or she must then decide how to physically orient themselves so as to be able to efficiently receive and control the ball from the known location and quickly and accurately pass it to the lone target or to the primary or secondary target.

After a predetermined time period has elapsed since the first detectable signal and the illumination of the target stations, a second detectable signal is generated, advising the player that a ball is being delivered from the location occupied by the coach. The player is aware of the ball source, just as he or she would be in a game situation. The time interval between the first and second detectable signals is predetermined by the coach or the software program and is shorter for more skilled players and longer for less skilled players. For example, a beginner may be allotted two (2) seconds, an experienced player one (1) second and a highly skilled player a half second.

As mentioned above, the preferred radius of the novel structure, i.e., the distance between player's location 14 and each target station 12, is seven (7) meters. That distance is not critical and may be decreased or increased as to all or some of the target stations by a coach depending upon the skills of the player, the space available, or to simulate different game situations.

Figure 5A:
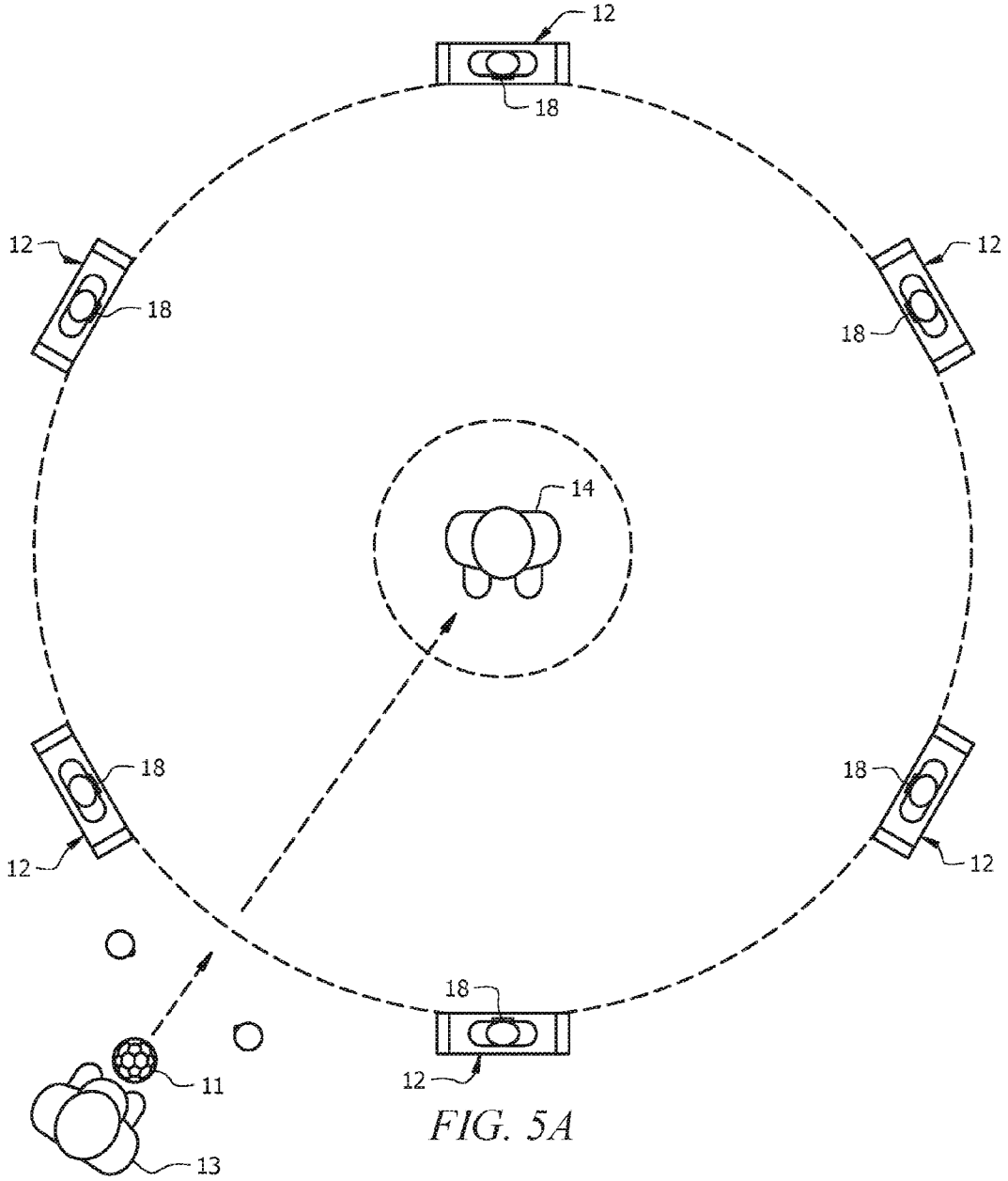
FIG. 5A is a top perspective view depicting the placement of a sensor for detecting the time of ball delivery by a coach.
Figure 5B:
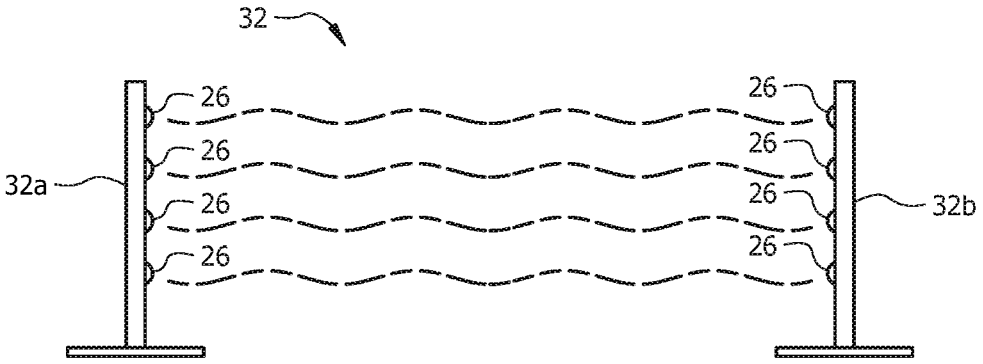
FIG. 5B is a front elevation of the sensor for detecting the time of ball delivery by a coach.

FIGS. 5A and 5B depict target stations 12 at varying radial distances from central player location 14. Said figures also depict a ball-delivery gate 32 having posts 32*a* and 32*b* upon which are mounted sensors such as sensors 26, 26 depicted in FIGS. 2 and 3. More particularly, a transmitter of electromagnetic energy is mounted to a preselected leg of the laterally spaced apart legs and a receiver of electromagnetic energy is mounted to a preselected leg of the laterally spaced apart legs. Thus, the transmitter and receiver may be mounted to opposing legs or to the same leg with a reflective member mounted to the opposing leg. The receiver is adapted to generate and transmit a signal when it detects a break in the transmitted electromagnetic energy.

Ball delivery gate 32 is positioned so that a ball delivered by a coach 13 to central player location 14 must pass between posts 32*a*, 32*b* as depicted in FIG. 5A. Sensors 26, 26 act in the same way as the passing box sensors of FIGS. 2 and 3, generating and transmitting a signal when a ball breaks the electromagnetic beam. This optional ball-delivery gate can be used to provide a more accurate measurement of the period of time between actual ball delivery and the recording of a ball entering into passing box 24 because it eliminates the delay between the second detectable signal and the coach's response to the second detectable signal.

FIG. 6A depicts a simplified target station 12 where LED light box 28 surmounts post 34. This simplified embodiment eliminates silhouette part 16. Moreover, LED light box 28, as in the silhouette-including embodiment, may be provided in the form of a blank, screen-like surface upon which light is projected from a predetermined location.

Advantageously, as depicted in FIG. 6B, a silhouette part 16 made of fabric or similar material may be placed over LED light box or screen-like surface 28. FIG. 6B also depicts a variation of base 18 and legs 22. No particular base or leg design is critical to the invention.

FIG. 6C indicates how a CPU or WI-FI unit 18*a* may be secured to a rearward side of base 18 to protect it from ball contact and how batteries 18*b* might be mounted to legs 22. FIG. 6C also diagrammatically depicts photoelectric transmitter or receiver 18*c*.

Each target station 12 is preferably self-powered with batteries as indicated in said FIG. 6C and is preferably wirelessly connected to a main unit or to a handheld device controlled by a coach.

A player stands in the center of the circle at location 14 and prepares to receive a pass from a coach who may be positioned at any preselected location and any preselected distance from the player.

Before delivering the ball to the player, the coach activates a remote control device which may take the form of a smart phone having an app for the training device. Pressing a first button activates a detectable signal and illuminates the target station lights so that one or more target stations is uniquely illuminated by light color or light pattern, thereby signifying the intended target or targets. The first detectable signal alerts the player that a ball is about to be fed to the player and that all of the target stations need to be quickly observed in order to locate the unique target or targets. The ball is fed to the player upon the sounding of a second detectable signal. The time interval between the first and second detectable signals is predetermined by the coach or the software program. The ball is consistently delivered to the player from a known location because in a real game situation, every competent player knows where the ball is at all times and no valuable skill is gained by feeding the ball to a player from surprising, unknown directions as in the prior art training devices. The coach can deliver the ball or puck from different locations and differing distances, speeds, heights, spins etc., but the player will always be able to see the coach and will not be surprised by a ball dispensed from a random location.

LED lights 28 of each target station 12 are preferably illuminated when the first detectable signal is generated, i.e., the player detects a buzzer or other detectable signal and sees the lights simultaneously. The player is required to observe all of the target stations 12 quickly because in a first embodiment only one of them will have a light color or pattern that differs from the others, i.e., that is oddly illuminated. The oddly-illuminated target is the one to which the ball is to be passed.

The ball may be fed to the player by the coach at whatever speed, height or direction the coach may select. The provision of a mechanical ball feeder is within the scope of this invention but is not preferred in keeping with the objects of the invention.

The Observe, Orient and Decide functions of the OODA loop should have already been made by the player when the ball arrives so that the player can concentrate on the Act/Action part of the loop, i.e., executing the decision that he or she reached prior to the ball being passed, with the objective of passing the ball into passing basket 24 of the designated target. Again, the lights indicating the designated target can be changed to make player reassess the situation and go through the OODA loop again.

Depending on the time intervals chosen, i.e., the time between the first detectable signal and the second detectable signal as well as the time given to the player to pass the ball into the target or be defaulted, as well as the rest period between balls as selected by the coach, it is estimated that a twenty (20) ball session can be completed in about two (2) minutes. This would allow individual players more opportunities to practice the OODA loop and practice the fundamental skills necessary to execute or act out their decision than they would in a two (2) hour team training session.

A coach could run an entire eighteen (18) person team through the novel apparatus (giving each player 2-20 ball sessions) in less time than a typical training session. Moreover, two (2) players can run the drill, one receiving, the other dispensing balls, while the coach continues to practice with the rest of the team thereby not interrupting a regular practice, or multiple players can use the device simultaneously working either as teammates or as small teams thereby adding an additional level of complexity to the drills.

In addition to providing more repetitions, the novel device records objective information such as the elapsed time between the second detectable signal and pass completion as well as the accuracy of the passes. This data together with recorded video data provides objective data for coaches allowing them to evaluate players' strengths and weakness so as to refine their individual training needs.

The objective is for the player to have a full, three hundred sixty degree (360°) awareness of his or her surroundings so that the target station 12 that differs from the others can be quickly identified and so that the player can physically orient his or her body in the optimal manner to efficiently receive, control and pass the ball to the designated target station.

The target station and the odd/minority light color or light pattern is randomly selected by the software program or assigned by the coach in order to test specific skills such as receiving the ball with a dominant or non-dominant foot, turning in a particular direction and passing with the dominant or non-dominant foot. Once the player has identified the target station he or she must physically orient him or herself in the optimal position to receive and control the incoming pass and then execute a controlled pass to the target station which may be located behind, in front or to any side of the player.

Since the time between the first and second detectable signals can be controlled, the speed of the drill can be changed to make it more or less challenging. The novel structure also teaches correct receiving of the ball and first touch, both of which are fundamental skills in the game of soccer. For example, if the oddly-illuminated target station is behind the player, he or she must decide which way to turn and, depending on the speed of the ball, either take a first touch or allow the ball to pass partially by him or her and then pass the ball on to the target station. When the player allows the ball to pass by him or her, the player orientates his or her body so that a ball which is already travelling in the correct path passes the player and the player then uses his or her first touch to direct the already-moving ball to the designated target.

The same drill can be automated based on a certain number of balls, for example twenty (20) balls with two (2) seconds of elapsed time between each detectable signal and a set time interval prior to the next set of detectable signals.

Finally, it would be possible to make the device a one-player-controlled training device by inserting rebounding boards across each target station box, each equipped with a pressure pad that would record the same information as the light beam associated with each passing basket 24 and also serve to return the ball or puck to the player and immediately begin the target lighting sequence. This final aspect is less ideal than having a mechanical feeder which would be controlled by the player, which is also a possibility but which would add both cost and reduce the portability of the product.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for improving the skills of a sports player, comprising:

a plurality of target stations arranged about a player location, wherein each target station includes a visual display;

a signal generating system for generating a first detectable signal when at least one visual displays is illuminated with a light color or light pattern different from visual displays on other targets;

a sport implement to be delivered to said player location;

said visual display mounted on each target so that a player positioned at said central player location can see each visual display;

each of said plurality of target stations including a base, wherein each base is adapted to receive said sport implement propelled by a player at said player location;

a transmitter of electromagnetic energy mounted to a preselected leg of said laterally spaced apart legs;

a receiver of electromagnetic energy mounted to a preselected leg of said laterally spaced apart legs; and said receiver adapted to generate and transmit a signal when said receiver detects a break in said transmitted electromagnetic energy.

2. The apparatus of claim 1, wherein each base further comprising a top wall and laterally spaced apart legs to position said top wall a preselected distance above a ground surface;

said top wall and said legs defining a passing box when positioned on a ground surface; and a receiving net secured to each passing box of each said plurality of target stations, said receiving net positioned on a radially outward side of each passing box so that said receiving net does not interfere with a sport implement entering said passing box from said central player location.

3. The apparatus of claim 2, further comprising:

a gate positioned between said delivery system and said player location so that a sport implement delivered to a player at said player location must pass through said gate;

said gate including a pair of laterally spaced apart posts;

a transmitter of electromagnetic energy mounted to a preselected post of said laterally spaced apart posts;

a receiver of electromagnetic energy mounted to a preselected leg of said laterally spaced apart posts; and said receiver adapted to generate and transmit a signal when said receiver detects a break in said transmitted electromagnetic energy; said signal reporting the time a sport implement is delivered to a player.

* * * * *